US011834812B2

(12) United States Patent
Yamawaki et al.

(10) Patent No.: US 11,834,812 B2
(45) Date of Patent: Dec. 5, 2023

(54) METHOD FOR CALIBRATING WORK MACHINE, CONTROLLER FOR WORK MACHINE, AND WORK MACHINE

(71) Applicant: KOMATSU LTD., Tokyo (JP)

(72) Inventors: Shota Yamawaki, Tokyo (JP); Shogo Miyazaki, Tokyo (JP)

(73) Assignee: KOMATSU LTD., Tokyo (JP)

( * ) Notice: Subject to any disclaimer, the term of this patent is extended or adjusted under 35 U.S.C. 154(b) by 231 days.

(21) Appl. No.: 17/426,364

(22) PCT Filed: Mar. 18, 2020

(86) PCT No.: PCT/JP2020/012064
§ 371 (c)(1),
(2) Date: Jul. 28, 2021

(87) PCT Pub. No.: WO2020/203314
PCT Pub. Date: Oct. 8, 2020

(65) Prior Publication Data

US 2022/0098834 A1 Mar. 31, 2022

(30) Foreign Application Priority Data

Mar. 29, 2019 (JP) ..... 2019-067316

(51) Int. Cl.
*E02F 9/26* (2006.01)
*E02F 3/28* (2006.01)
(Continued)

(52) U.S. Cl.
CPC ..... *E02F 9/264* (2013.01); *E02F 3/283* (2013.01); *E02F 3/431* (2013.01); *E02F 9/2271* (2013.01)

(58) Field of Classification Search
CPC ..... E02F 3/283; E02F 3/3411; E02F 3/431; E02F 9/2271; E02F 9/264
See application file for complete search history.

(56) References Cited

U.S. PATENT DOCUMENTS 7,993,091 B2 * 8/2011 Osanai ..... E02F 3/432 414/685
9,556,590 B2 * 1/2017 Moriki ..... B60K 6/46
(Continued)

FOREIGN PATENT DOCUMENTS

CN 1651666 A 8/2005
CN 105121753 A 12/2015
(Continued)

OTHER PUBLICATIONS

The Office Action for the corresponding Chinese application No. 202080009665.2, dated Apr. 18, 2022.
(Continued)

*Primary Examiner* — Tyler J Lee
(74) *Attorney, Agent, or Firm* — Global IP Counselors, LLP

(57) ABSTRACT

A work machine includes a main body, a boom to drive with respect to the main body, a work tool connecting to the boom, the work tool to drive with respect to the boom, an actuator connecting to the main body and the work tool, the actuator to drive the work tool, and a sub-link to transmit drive of the actuator to the work tool. A method for calibrating the work machine includes outputting a detection value to detect an angle of the sub-link with respect to the boom in a predetermined posture of the boom and a work tool posture, converting the detection value as a measurement angle of the sub-link with respect to the boom based on a conversion value, and calibrating the conversion value based on a relationship between the measurement angle and an actual angle in the work tool posture which is specified.

9 Claims, 14 Drawing Sheets

(51) Int. Cl.
*E02F 3/43* (2006.01)
*E02F 9/22* (2006.01)

(56) References Cited

U.S. PATENT DOCUMENTS

| | | | | |
|---|---|---|---|---|
| 11,293,169 | B2 * | 4/2022 | Ueda | G07C 5/08 |
| 2006/0291987 | A1 * | 12/2006 | Osanai | E02F 3/432 414/685 |
| 2011/0301781 | A1 | 12/2011 | Karlsson et al. | |
| 2012/0330515 | A1 * | 12/2012 | Numazaki | F15B 11/048 701/50 |
| 2014/0291038 | A1 | 10/2014 | Hague et al. | |
| 2015/0139767 | A1 * | 5/2015 | Moriki | E02F 3/431 414/699 |
| 2016/0281334 | A1 | 9/2016 | Iwamura et al. | |
| 2018/0363269 | A1 | 12/2018 | Fujii et al. | |
| 2020/0002914 | A1 | 1/2020 | Yoshida et al. | |
| 2020/0131739 | A1 * | 4/2020 | Ueda | G01G 19/10 |

FOREIGN PATENT DOCUMENTS

| | | | |
|---|---|---|---|
| EP | 3 382 105 | A1 | 10/2018 |
| JP | 2005-121437 | A | 5/2005 |
| JP | 4671405 | B2 | 4/2011 |
| JP | 2011-196070 | A | 10/2011 |
| JP | 2011-227379 | A | 11/2011 |
| JP | 2014-1596 | A | 1/2014 |
| WO | 2019/058622 | A1 | 3/2019 |

OTHER PUBLICATIONS

The extended European search report for the corresponding European application No. 20782556.3, dated Oct. 21, 2022.
The International Search Report for the corresponding international application No. PCT/JP2020/012064, dated Jun. 9, 2020.

* cited by examiner

| BUCKET CYLINDER LENGTH | | | | | | | | | | | |
|---|---|---|---|---|---|---|---|---|---|---|---|
| | BELL CRANK ANGLE θb | | | | | | | | | | |
| BOOM ANGLE θa | | θ1 | θ2 | θ3 | θ4 | θ5 | θ6 | θ7 | θ8 | θ9 | θ10 |
| | θ11 | L1 | L2 | L3 | L4 | L5 | L6 | L7 | L8 | L9 | L10 |
| | θ12 | L11 | L12 | L13 | L14 | L15 | L16 | L17 | L18 | L19 | L20 |
| | θ13 | L21 | L22 | L23 | L24 | L25 | L26 | L27 | L28 | L29 | L30 |
| | θ14 | L31 | L32 | L33 | L34 | L35 | L36 | L37 | L38 | L39 | L40 |
| | θ15 | L41 | L42 | L43 | L44 | L45 | L46 | L47 | L48 | L49 | L50 |
| | θ16 | L51 | L52 | L53 | L54 | L55 | L56 | L57 | L58 | L59 | L60 |
| | θ17 | L61 | L62 | L63 | L64 | L65 | L66 | L67 | L68 | L69 | L70 |
| | θ18 | L71 | L72 | L73 | L74 | L75 | L76 | L77 | L78 | L79 | L80 |
| | θ19 | L81 | L82 | L83 | L84 | L85 | L86 | L87 | L88 | L89 | L90 |
| | θ20 | L91 | L92 | L93 | L94 | L95 | L96 | L97 | L98 | L99 | L100 |

FIG. 12

METHOD FOR CALIBRATING WORK MACHINE, CONTROLLER FOR WORK MACHINE, AND WORK MACHINE

CROSS-REFERENCE TO RELATED APPLICATIONS

This application is a U.S. National stage application of International Application No. PCT/JP2020/012064, filed on Mar. 18, 2020. This U.S. National stage application claims priority under 35 U.S.C. § 119(a) to Japanese Patent Application No. 2019-067316, filed in Japan on Mar. 29, 2019, the entire contents of which are hereby incorporated herein by reference.

BACKGROUND

Filed of the Invention

The present invention relates to a method for calibrating a work machine a controller for a work machine, and a work machine.

Background Information

A wheel loader as an example of a work machine has a work implement with a bucket at the tip of the boom. A hydraulic cylinder for boom is provided between the vehicle body of the wheel loader and the boom, and the boom rotates in the vertical direction due to expansion and contraction of the hydraulic cylinder.

A bell crank is attached to the boom, and a hydraulic cylinder for a bucket is provided between one end of the bell crank and the vehicle body. The other end of the bell crank is attached to the bucket. When the hydraulic cylinder for the bucket extends, the bucket rotates in the tilt direction, and when the hydraulic cylinder for the bucket contracts, the bucket rotates in the dump direction.

In such a wheel loader, the posture of work implement is grasped from the operation table of the bucket with respect to the expansion and contraction of the bucket cylinder in consideration of the bucket shape.

SUMMARY

However, on the premise of bucket replacement, it is required to grasp the bell crank angle that causes the detection error of the posture of work implement.

An object of the present invention is to provide a method for calibrating a work machine, a controller for a work machine, and a work machine capable of calibrating a measurement value of a bell crank angle in an actual operating angle region.

The method for calibrating the work machine according to the invention is a method for calibrating the work machine including a main body, a boom configured to drive with respect to the main body, a work tool connecting to the boom and configured to drive with respect to the boom, an actuator connecting to the main body and the work tool respectively and configured to drive the work tool, and a sub-link configured to transmit drive of the actuator to the work tool. The method includes an output step, a conversion step, and a calibration step. In the output step a detection value for detecting the angle of the sub-link with respect to the boom in a predetermined posture of the boom and a work tool posture, which are specified, is output. In the conversion step the detection value is converted as a measurement angle of the sub-link with respect to the boom based on a converted value. In the calibration step the conversion value is calibrated based on relationship between the measurement angle and an actual angle in the working tool posture which is specified.

The controller for the work machine according to the invention is a controller for the work machine including a main body, a boom configured to drive with respect to the main body, a work tool connecting to the boom and configured to drive with respect to the boom, an actuator connecting to the main body and the work tool respectively and configured to drive the work tool, and a sub-link configured to transmit drive of the actuator to the work tool. The controller include an acquisition section, a display section, and a calibration section. The acquisition section acquires a detection value for detecting the angle of the sub-link with respect to the boom. The display section displays information for specifying a predetermined posture of the boom and a work tool posture when calibrating the conversion value for converting the detection value as the measurement angle of the sub-link with respect to the boom. The calibration section calibrates the conversion value by relationship an actual angle in a specified work tool posture and the measurement angle obtained by converting the detection value in a specified predetermined posture of the boom and a specified work tool posture, which are input based on a display on the display section, based on the conversion value.

The work machine according to the invention is an articulated wheel loader in which a front frame and a rear frame are connected, and includes a controller for the work machine and an angle detection section. The angle detection section transmits a detection value for detecting an angle of a sub-link with respect to a boom to the controller of the wheel loader.

EFFECT OF THE INVENTION

According to the present invention, it is possible to provide a method for calibrating a work machine, a controller for a work machine, and a work machine capable of calibrating a measurement value of a bell crank angle in an actual operating angle region.

BRIEF DESCRIPTION OF THE DRAWINGS

FIG. 12 is a view showing a bucket cylinder length table.

DETAILED DESCRIPTION OF EMBODIMENT(S)

Hereinafter, a wheel loader 1 (an example of a work machine) according to the embodiment of the present invention will be described with reference to the drawings.

(Configuration)

(Outline of Configuration of Wheel Loader 1)

Figure 1:
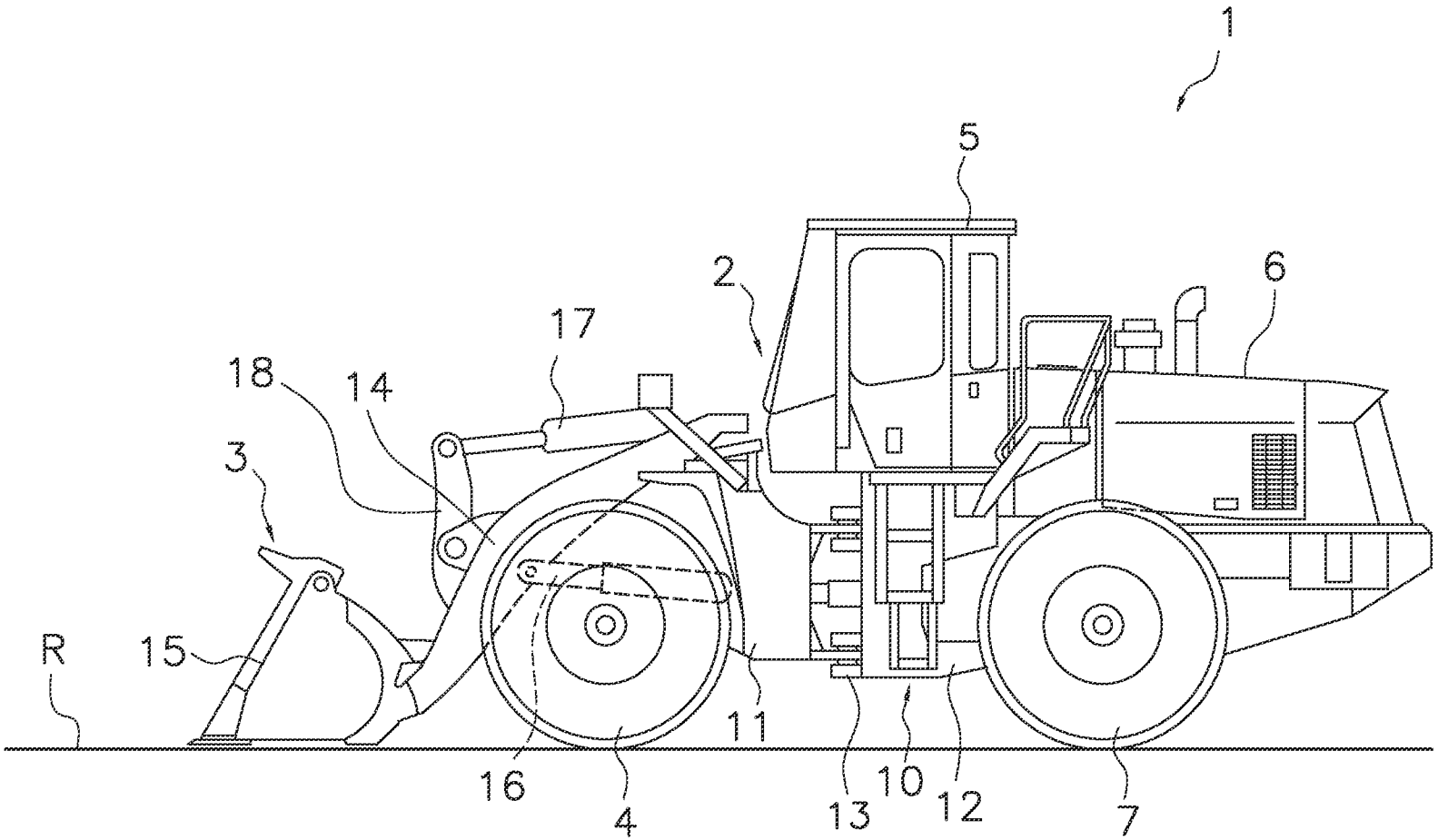
FIG. 1 is a side view of a wheel loader according to an embodiment of the present invention.

FIG. 1 is a schematic view showing the configuration of the wheel loader 1 of the present embodiment.

The wheel loader 1 of the present embodiment includes a vehicle body 2 (an example of a main body) and work implement 3. The vehicle body 2 includes a vehicle body frame 10, a pair of front tires 4, a cab 5, an engine room 6, a pair of rear tires 7, and a control system 8 (see FIG. 3).

The wheel loader 1 uses a work implement 3 to perform earth and sand loading work and the like.

The vehicle body frame 10 is a so-called articulated type, and includes a front frame 11, a rear frame 12, and a connecting shaft part 13. The front frame 11 is arranged in front of the rear frame 12. The connecting shaft part 13 is provided at a center in a vehicle width direction, and connects the front frame 11 and the rear frame 12 so as to be swingable to each other.

The cab 5 is provided on the rear frame 12 and a driver's seat is arranged in the cab 5. The cab 5 is provided with an input/output device 50 described later, a boom operating lever 61, a bucket operating lever 62, and the like.

The pair of front tires 4 are attached to left and right sides of the front frame 11. Further, a pair of rear tires 7 are attached to left and right sides of the rear frame 12.

Figure 2:
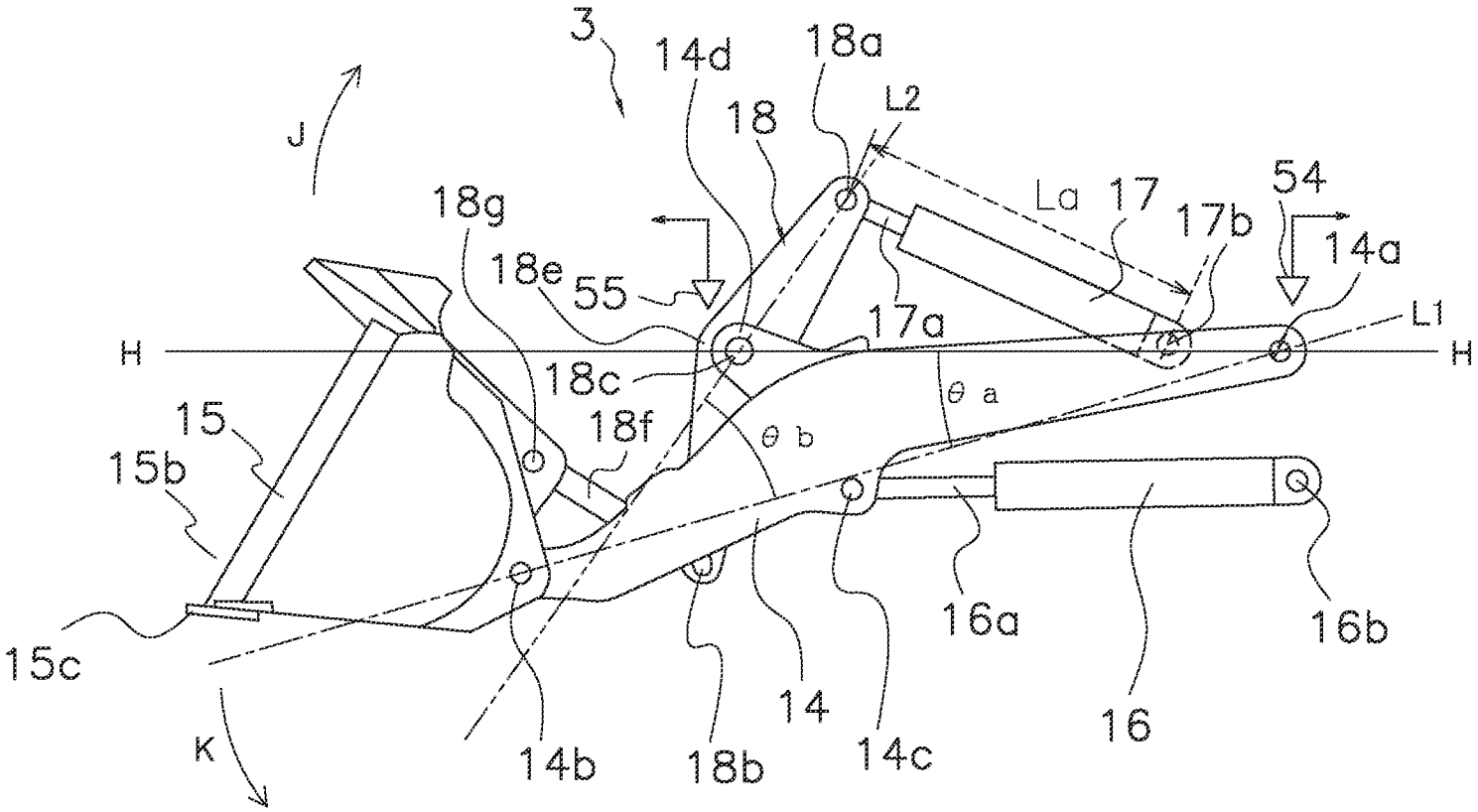
FIG. 2 is a side view of the work implement of FIG. 1.

The work implement 3 is driven by hydraulic fluid from the work implement pump. FIG. 2 is an enlarged side view of work implement 3.

The work implement 3 includes a boom 14, a bucket 15 (an example of a work tool), a boom cylinder 16, a bucket cylinder 17 (an example of an actuator), and a bell crank 18 (an example of a sub-link).

One attachment part 14*a* of the boom 14 is rotatably attached to the front part of the front frame 11. The other attachment part 14*b* of the boom 14 is rotatably attached to the rear part of the bucket 15. The tip of the cylinder rod 16*a* of the boom cylinder 16 is rotatably attached to the attachment part 14*c* provided between the attachment part 14*a* and the attachment part 14*b* of the boom 14. The cylinder body of the boom cylinder 16 is rotatably attached to the front frame 11 at the attachment part 16*b*.

The bell crank 18 includes a bell crank main body 18*e* and a rod 18*f*. The attachment part 18*a* provided at one end part of the bell crank main body 18*e* is rotatably attached to the tip of the cylinder rod 17*a* of the bucket cylinder 17. One end of the rod 18*f* is rotatably attached to an attachment part 18*b* provided at the other end of the bell crank main body 18*e*. The other end of the rod 18*f* is rotatably attached to the rear part of the bucket 15 at the attachment part 18*g*. The bell crank main body 18*e* rotatably supported by a bell crank support 14*d* near the center of the boom 14 at the attachment part 18*c* (an example of a fourth mounting part) provided between the attachment part 18*a* (an example of a second mounting part) and the attachment part 18*b* (an example of a third mounting part). The cylinder body of the bucket cylinder 17 is rotatably attached to the front frame 11 at the attachment part 17*b* (an example of a first attachment part). The expansion and contraction force of the bucket cylinder 17 is converted into a rotary motion by the bell crank and transmitted to the bucket 15.

The bell crank 18 corresponds to an example of a sub-link. The sub-link may include a quick coupler or the like in addition to the bell crank 18.

Due to the expansion and contraction of the bucket cylinder 17, the bucket 15 rotates with respect to the boom 14 to perform a tilt operation (see arrow J) and a dump operation (see arrow K). Here, the tilt operation of the bucket 15 is an operation in which the bucket 15 tilts by the opening 15*b* and the claw 15*c* of the bucket 15 rotating toward the cab 5. The dump operation of the bucket 15 is the opposite of the tilt operation, and is an operation in which the bucket 15 tilts by the opening 15*b* and the claw 15*c* of the bucket 15 moving away from the cab 5.

The boom angle sensor 54 is provided on the attachment part 14*a* of the boom 14. The boom angle sensor 54 detects the boom angle (indicated by θa in the figure) between the center line L1 of the boom 14 and the horizontal line H as a voltage value, and outputs the detected detection voltage. The center line L1 of the boom 14 is a line connecting the attachment part 14*a* and the attachment part 14*b* of the boom 14. The boom angle has a negative value when the center line L1 is inclined toward the road surface R (see FIG. 1) with respect to the horizontal line H.

A bell crank angle sensor 55 (an example of an angle detection section) is provided on the attachment part 18*c* of the bell crank 18. The bell crank angle sensor 55 detects the bell crank angle (indicated by θb in the figure) between the line L2 connecting the attachment part 18*a* and the attachment part 18*c* of the bell crank 18 and the center line L1 of the boom 14 as a voltage value, and outputs the detected detection voltage.

(Control System)

Figure 3:
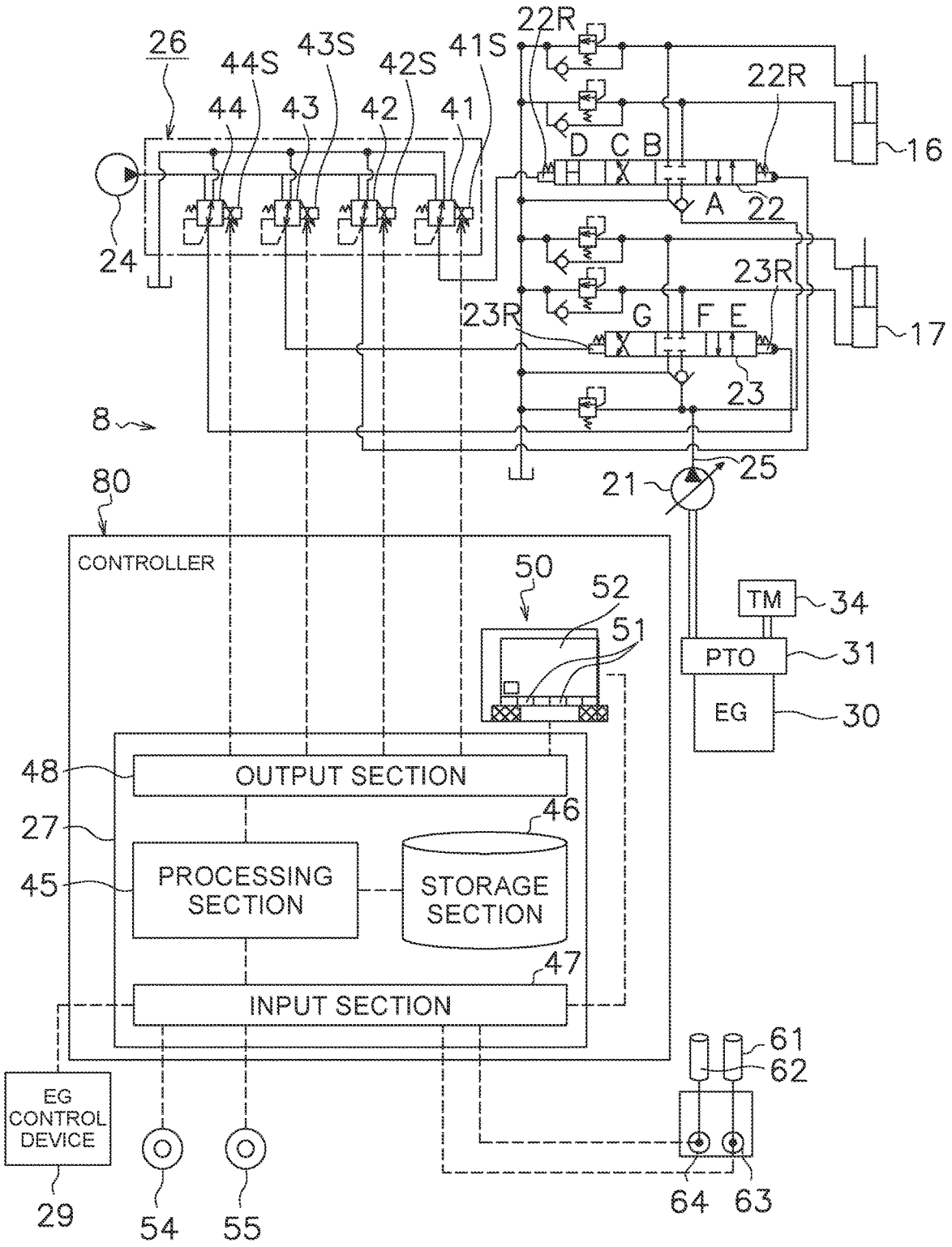
FIG. 3 is a block diagram showing a control system of FIG. 1.

FIG. 3 is a view showing a control system 8 that controls operation of the work implement 3.

The control system 8 controls operation of the work implement 3. The control system 8 includes a work implement hydraulic pump 21, a boom operating valve 22, a bucket operating valve 23, a pilot pump 24, a discharge circuit 25, an electromagnetic proportional control valve 26, a controller 80, and EG (engine) control device 29.

(Work Implement Hydraulic Pump)

The work implement hydraulic pump 21 is driven by the engine 30 mounted in the engine room 6. The engine 30 is an internal combustion engine, and for example, a diesel engine is used. The output of the engine 30 is input to the PTO (power Take Off) 31, and then output to the work implement hydraulic pump 21 and the transmission 34. The work implement hydraulic pump 21 is driven by the engine 30 via the PTO 31 to discharge the hydraulic fluid. The output of the engine 30 is transmitted to the transmission 34 via the PTO 31. The transmission 34 transmits the output of the engine 30 transmitted via the PTO 31 to the front tire 4 and the rear tire 7, and the front tire 4 and the rear tire 7 are driven. As, the transmission 34, HST (Hydro Static Transmission), electric drive, and the like can be appropriately used.

(Discharge Circuit, Boom Operating Valve, Bucket Operating Valve)

The discharge circuit 25 is an oil passage through which the hydraulic fluid passes, and is attached to a discharge port in which the work implement hydraulic pump 21 discharges the hydraulic fluid. The discharge circuit 25 is attached to the boom operating valve 22 and the bucket operating valve 23. The boom operating valve 22 and the bucket operating valve 23 are hydraulic pilot type operating valves. The boom operating valve 22 and the bucket operating valve 23 are attached to the vehicle body 2. The work implement hydraulic pump 21, the boom operating valve 22, the bucket operating valve 23, and the discharge circuit 25 form a parallel-type hydraulic circuit.

The boom operating valve 22 is a 4-position switching valve that can be switched between an A position, a B position, a C position, and a D position. The boom 14 raises when the boom operating valve 22 is in the A position, the boom 14 holds the position neutrally when the boom operating valve 22 is in the B position, the boom 14 lowers when the boom operating valve 22 is in the C position, and D position is "floating".

The bucket operating valve 23 is a three-position switching valve that can be switched between a E position, a F position, and a G position. The bucket 15 tilts (see arrow J in FIG. 2) when the bucket operating valve 23 is in the E position, the bucket 15 holds the position neutrally when the bucket operating valve 23 is in the F position, and the bucket 15 dumps (see arrow K in FIG. 2) when the bucket operating valve 23 is in the G position (Pilot Pump)

The pilot pump 24 is attached to pilot pressure receiving parts of the boom operating valve 22 and pilot pressure receiving parts of the bucket operating valve 23 via the electromagnetic proportional control valve 26. The pilot pump 24 is connected to the PTO 31 and is driven by the engine 30. The pilot pump 24 supplies a hydraulic fluid of pilot pressure to the pilot pressure receiving parts 22R of the boom operating valve 22 and the pilot pressure receiving parts 23R of the bucket operating valve 23 via the electromagnetic proportional control valve 26.

(Electromagnetic Proportional Control Valve)

The electromagnetic proportional control valve 26 includes a boom lowering electromagnetic proportional control valve 41, a boom raising electromagnetic proportional control valve 42, a bucket dump electromagnetic proportional control valve 43, and a bucket tilt electromagnetic proportional control valve 44.

The boom lowering electromagnetic proportional control valve 41 and the boom raising electromagnetic proportional control valve 42 are attached to each pilot pressure receiving parts 22R of the boom operating valve 22. The bucket dump electromagnetic proportional control valve 43 and the bucket tilt electromagnetic proportional control valve 44 are attached to each pilot pressure receiving parts 23R of the bucket operating valve 23.

A command signal from the control device 27 to each solenoid proportional control valve is input to a solenoid command section 41S of the boom lowering electromagnetic proportional control valve 41, the solenoid command section 42S of the boom raising electromagnetic proportional control valve 42, the solenoid command section 43S of the bucket dump electromagnetic proportional control valve 43, and the solenoid command section 44S of the bucket tilt electromagnetic proportional control valve 44.

The boom 14 is rotated upward or downward by operations of the boom lowering electromagnetic proportional control valve 41, the boom raising electromagnetic proportional control valve 42, the boom operating valve 22, and the boom cylinder 16.

The bucket 15 is tilted and dumped by operation of the bucket dump electromagnetic proportional control valve 43, the bucket tilt electromagnetic proportional control valve 44, the bucket operating valve 23, and the bucket cylinder 17.

(Boom Operating Lever, Bucket Operating Lever)

The control system 8 is provided with a boom operating lever 61 and a bucket operating lever 62 operated by an operator. The boom operating lever 61 is a lever for operating the boom 14. A first potentiometer 63 for detecting the operation amount of the boom operating lever 61 is attached to the boom operating lever 61.

The bucket operating lever 62 is a lever for operating the bucket 15. A second potentiometer 64 for detecting the operation amount of the bucket operating lever 62 is attached to the bucket operating lever 62.

The detection voltages of the first potentiometer 63 and the second potentiometer 64 are input to the input section 47 of the control device 27.

The boom operating lever 61 and the bucket operating lever 62 may be PPC levers that directly drive the operating valve operating the cylinder with pilot pressure.

(Controller)

The controller 80 includes a control device 27 and an input/output device 50. The control device 27 controls the drive of work implement 3 and the like. The input/output device 50 is arranged in the cab 5, an instruction from the operator is input to the input/output device 50, and the input/output device 50 outputs an instruction to the operator.

(Control Device)

The control device 27 includes, for example, a processing section 45 such as a CPU (Central Processing Unit), a storage section 46 such as a ROM (Read Only Memory), an input section 47 (an example of an acquisition section), and an output section 48.

The processing section 45 controls operation of the work implement 3 by executing a computer program. The processing section 45 is electrically connected to the storage section 46, the input section 47, and the output section 48. The processing section 45 reads information from the storage section 46 and writes information to the storage section 46. The processing section 45 receives information from the input section 47. The processing section 45 outputs information from the output section 48.

The storage section 46 stores a computer program that controls operation of the work implement 3 and information used for controlling the work implement 3. The storage section 46 stores a computer program to execute a method for controlling the work machine, and the processing section 45 reads and executes this program.

The storage section 46 stores a bell crank angle conversion table T1 and a boom angle conversion table T2, which will be described later.

The detection voltages are input to the input section 47 from the boom angle sensor 54, the bell crank angle sensor 55, the first potentiometer 63, and the second potentiometer 64. The processing section 45 acquires these detection signals and controls operation of the work implement 3.

Further, the cylinder length of the bucket cylinder 17 (indicated by La in FIG. 2) is obtained from the boom angle detected by the boom angle sensor 54 and the bell crank angle detected by the bell crank angle sensor 55 using a bucket cylinder length table (see FIG. 12) described later.

The control device 27 obtains the cylinder length of the bucket cylinder 17 using the detection voltages of the boom angle sensor 54 and the bell crank angle sensor 55, and controls operation of the bucket 15.

The output section 48 outputs drive commands to the solenoid command section 41S of the boom lowering electromagnetic proportional control valve 41, the solenoid command section 42S of the boom raising electromagnetic proportional control valve 42, the solenoid command section 43S of the bucket dump electromagnetic proportional control valve 43, and the solenoid command section 44S of the bucket tilt electromagnetic proportional control valve 44, and the input/output device 50.

The processing section 45 gives a command value for operating the boom cylinder 16 to the solenoid command section 41S of the boom lowering electromagnetic proportional control valve 41 or the solenoid command section 42S of the boom raising electromagnetic proportional control valve 42, expands and contracts the boom cylinder 16, and raises and lowers the boom 14.

The processing section 45 gives a command value for operating the bucket cylinder 17 to the solenoid command section 43S of the bucket dump electromagnetic proportional control valve 43 or the solenoid command section 44S of the bucket tilt electromagnetic proportional control valve 44, expands and contracts the bucket cylinder 17, and tilts or dumps the bucket 15.

Further, the processing section 45 calibrates the bell crank angle detected by the bell crank angle sensor 55 and calibrates the boom angle detected by the boom angle sensor 54.

The input/output device 50 is provided inside the cab 5. The input/output device 50 is connected to both the input section 47 and the output section 48. The input/output device 50 includes an input device 51 and a display device 52 (an example of a display section). The operator can input a command value from the input device 51 to the control device 27. The display device 52 displays information on the status and the control of work implement 3 and the calibration.

A touch panel or a push button type switch can be used as the input device 51.

By operating the input device 51, a calibration mode for calibrating the bell crank angle or calibrating the boom angle can be displayed on the display device 52.

(Calibration Posture of Bell Crank Angle)

In the wheel loader 1 of the present embodiment, the bell crank angle is calibrated by acquiring the detection voltages from the bell crank angle sensor 55 while the work implement 3 is in the first bell crank calibration posture and the second bell crank calibration posture.

Calibrating the bell crank angle in the first bell crank calibration posture and the second bell crank calibration posture will be described.

Figure 4:
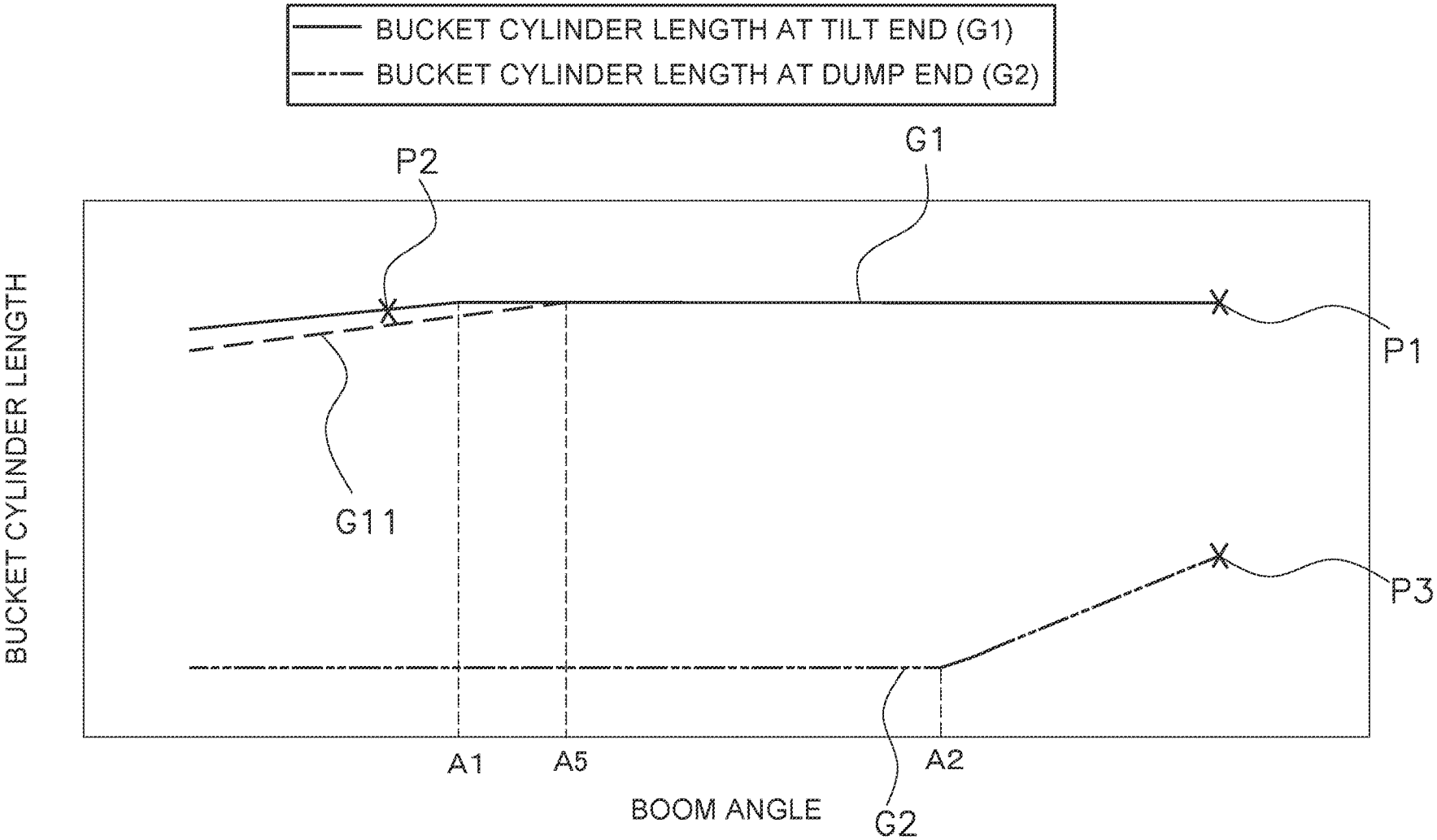
FIG. 4 is a view showing a change in a bucket cylinder length at a tilt end with respect to a boom angle and a change in a bucket cylinder length at a dump end with respect to a boom angle.

FIG. 4 is a view showing a change (G1) in the bucket cylinder length at the tilt end with respect to the boom angle and a change (G2) in the bucket cylinder length at the dump end with respect to the boom angle. The vertical axis shows the bucket cylinder length, and the horizontal axis shows the boom angle.

As shown in G1, when the boom angle is from the maximum value to A1 degree, the bucket reaches the tilt end at the maximum value of the cylinder length of the bucket cylinder 17.

Figure 5:
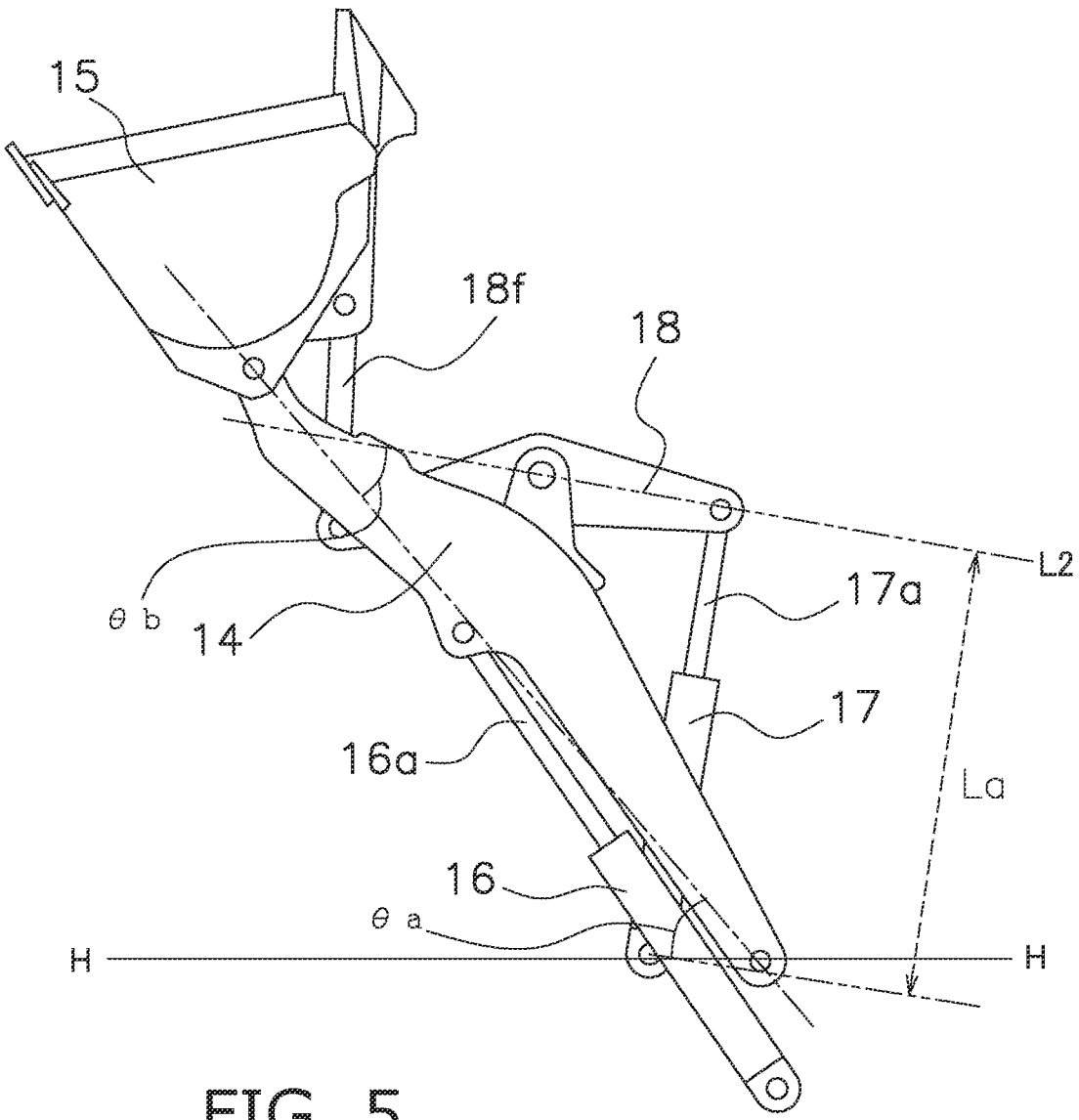
FIG. 5 is a view showing an example of a state of work implement in P1 of FIG. 4.

FIG. 5 is a view showing a state in which the bucket reaches the tilt end at the maximum value of the bucket cylinder 17, and is a view showing an example of a work implement state in P1 of FIG. 4. FIG. 5 shows a state in which the boom angle is the maximum value, the bucket cylinder 17 is fully extended to the maximum value, and the bucket 15 reaches the tilt end.

On the other hand, when the boom angle is from A1 degree to the minimum value, the bucket reaches the tilt end before the cylinder length of the bucket cylinder 17 reaches the maximum value.

Figure 6:
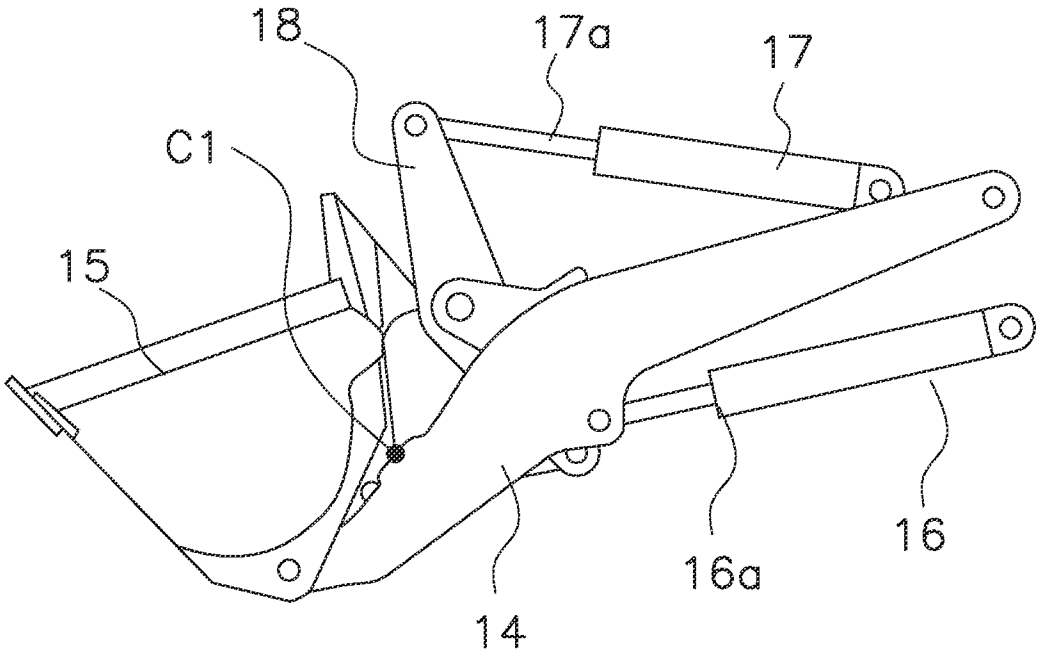
FIG. 6 is a view showing an example of a state of work implement in P2 of FIG. 4.

This is because the link mechanism of work implement 3 reaches the mechanism limit before the cylinder length of the bucket cylinder 17 reaches the maximum value, and the bucket cylinder 17 cannot be extended any more. FIG. 6 is a view showing an example of work implement 3 in P2 of FIG. 4. In the state shown in FIG. 6, since the bucket 15 is in contact with the bell crank 18, the bucket cylinder 17 cannot be extended any more. In FIG. 6, the contact position is illustrated as C1, but the contact position at the mechanical limit changes depending on the configuration of the link of work implement3.

In this way, the bucket 15 reaches the tilt end due to the mechanical limit of the link mechanism of work implement 3 from the minimum value to the angle A1, and the bucket 15 reaches the tilt end at the maximum value of the cylinder length of the bucket cylinder 17 from the angle A1 to the maximum value.

On the other hand, as shown in G2, the bucket reaches the dump end at the minimum value of the bucket cylinder 17 when the boom angle is from the minimum value to A2 degrees, but the bucket reaches the dump end before the cylinder length of the bucket cylinder 17 reaches the minimum value when the boom angle is from A2 degrees to the maximum value.

Figure 7:
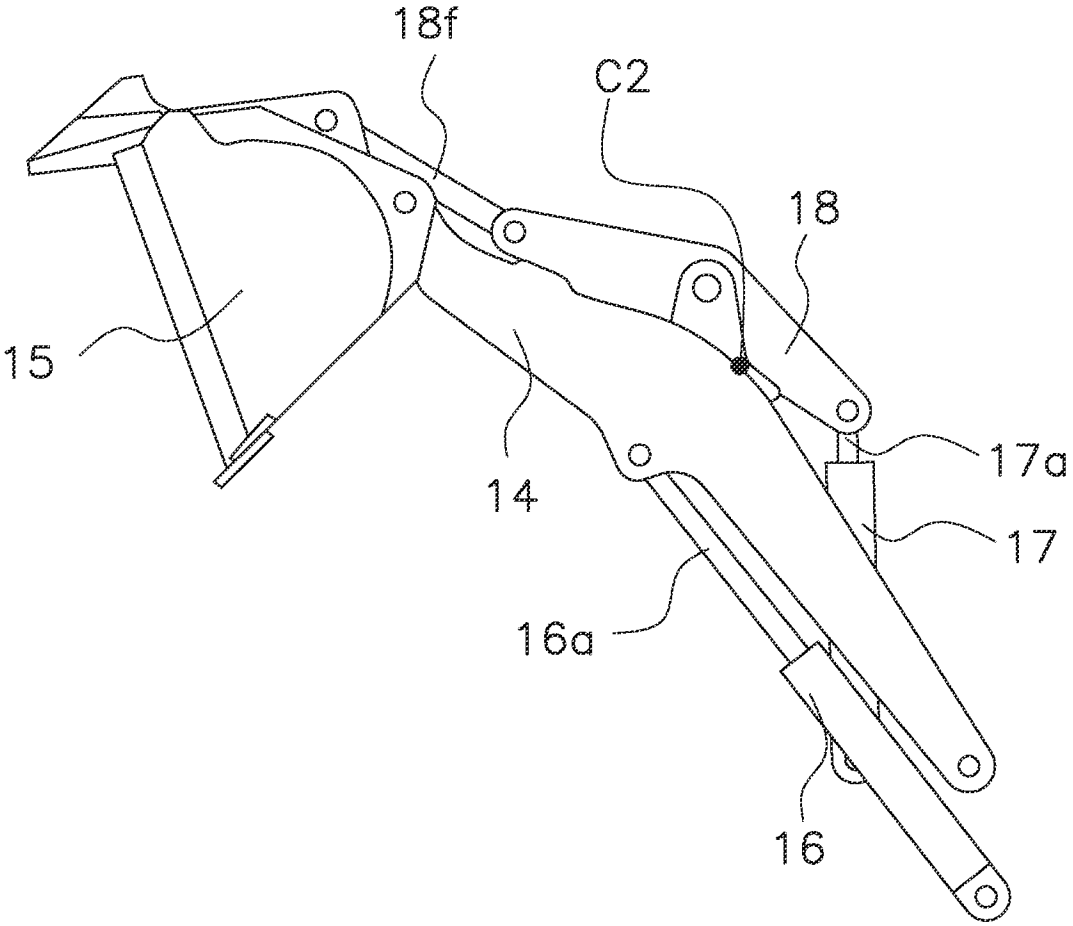
FIG. 7 is a view showing an example of a state of work implement in P3 of FIG. 4.

This is because the link mechanism of work implement 3 reaches the mechanism limit before the cylinder length of the bucket cylinder 17 reaches the minimum value, and the bucket cylinder 17 cannot be contracted any more. FIG. 7 is a view showing an example of work implement 3 in P3 of FIG. 4. In the state shown in FIG. 7, since the bell crank 18 is in contact with the frame part of the boom 14 arranged along the left-right direction, the bucket cylinder 17 cannot be contracted any more (see point C2).

In this way, the bucket cylinder 17 reaches the tilt end at the minimum value of the cylinder length of the bucket cylinder 17 when the boom angle is from the minimum value to A2 degrees, and the bucket 15 reaches the dump end due to the mechanical limits of the link mechanism of the work implement 3 when the boom angle is from the predetermined value to the maximum value.

As described above, in the region where the tilt end and the dump end are reached due to the mechanical limit, the stroke length of the bucket cylinder 17 depends on the boom angle, but since the link mechanism reaches the mechanical limit, the bell crank angle is constant.

Figure 8:
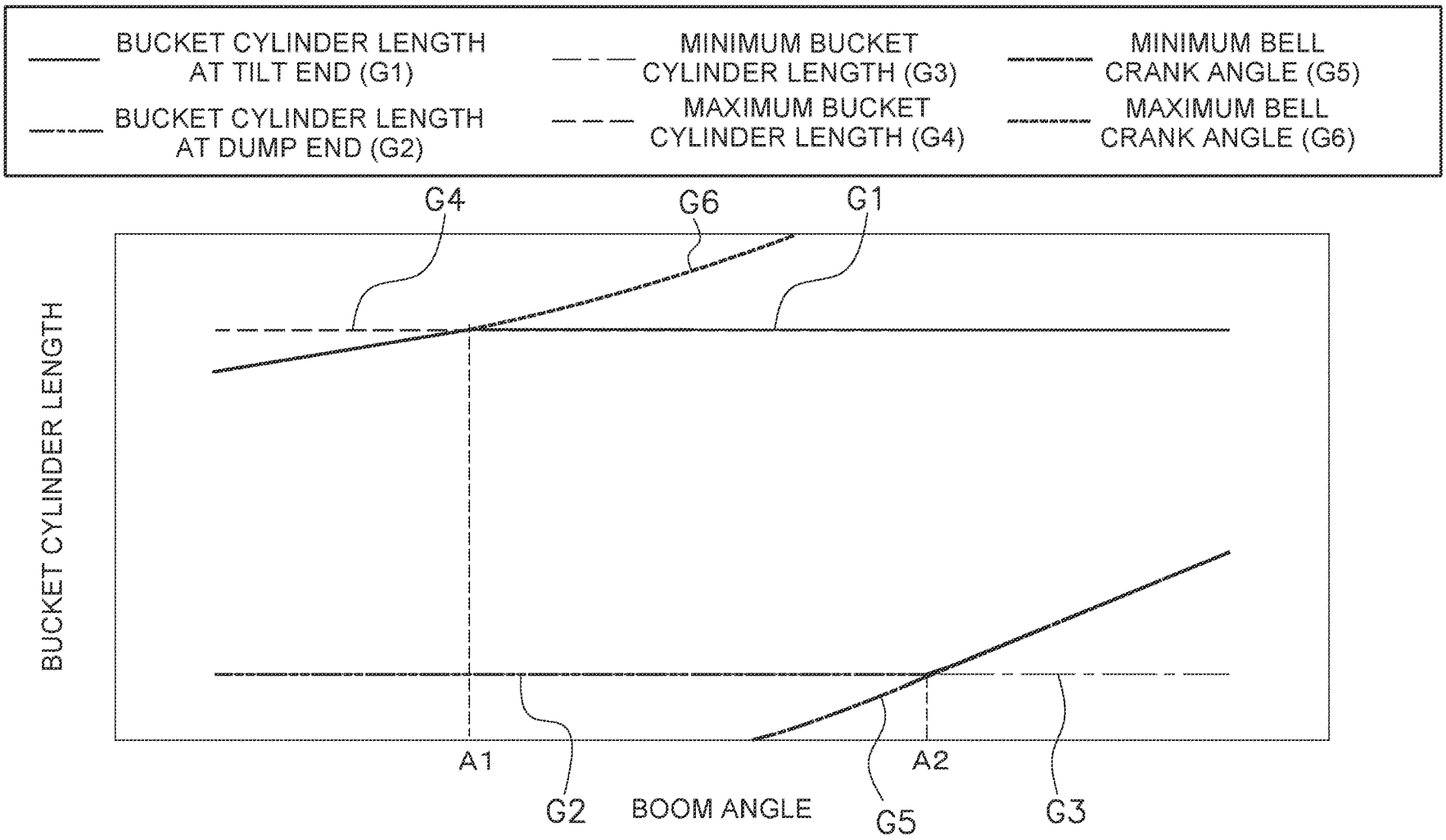
FIG. 8 is a view in which change in a minimum value of a bucket cylinder length, change in a maximum value of a bucket cylinder length, change in a minimum value of a bell crank angle, and change in a maximum value of the bell crank angle with respect to the boom angle are added to the graph of FIG. 5.

FIG. 8 is a view in which the minimum value of the bucket cylinder length (G3), the maximum value of the bucket cylinder length (G4), the minimum value of the bell crank angle (G5), and the maximum value of the bell crank angle (G6) are added to the graph of FIG. 5. The vertical axis shows the bucket cylinder length and the horizontal axis shows the boom angle.

As shown in G1 of the bucket cylinder length at the tilt end and G4 of the maximum value of the bucket cylinder length, the maximum value G6 of the bell crank angle matches G1 in the region where the stroke length of the bucket cylinder 17 does not reach the maximum value.

On the other hand, as shown in G2 of the bucket cylinder length at the dump end and G3 of the minimum value of the bucket cylinder length, the minimum value G5 of the bell crank angle matches G2 in the region where the bucket cylinder length does not reach the minimum value.

Figure 9:
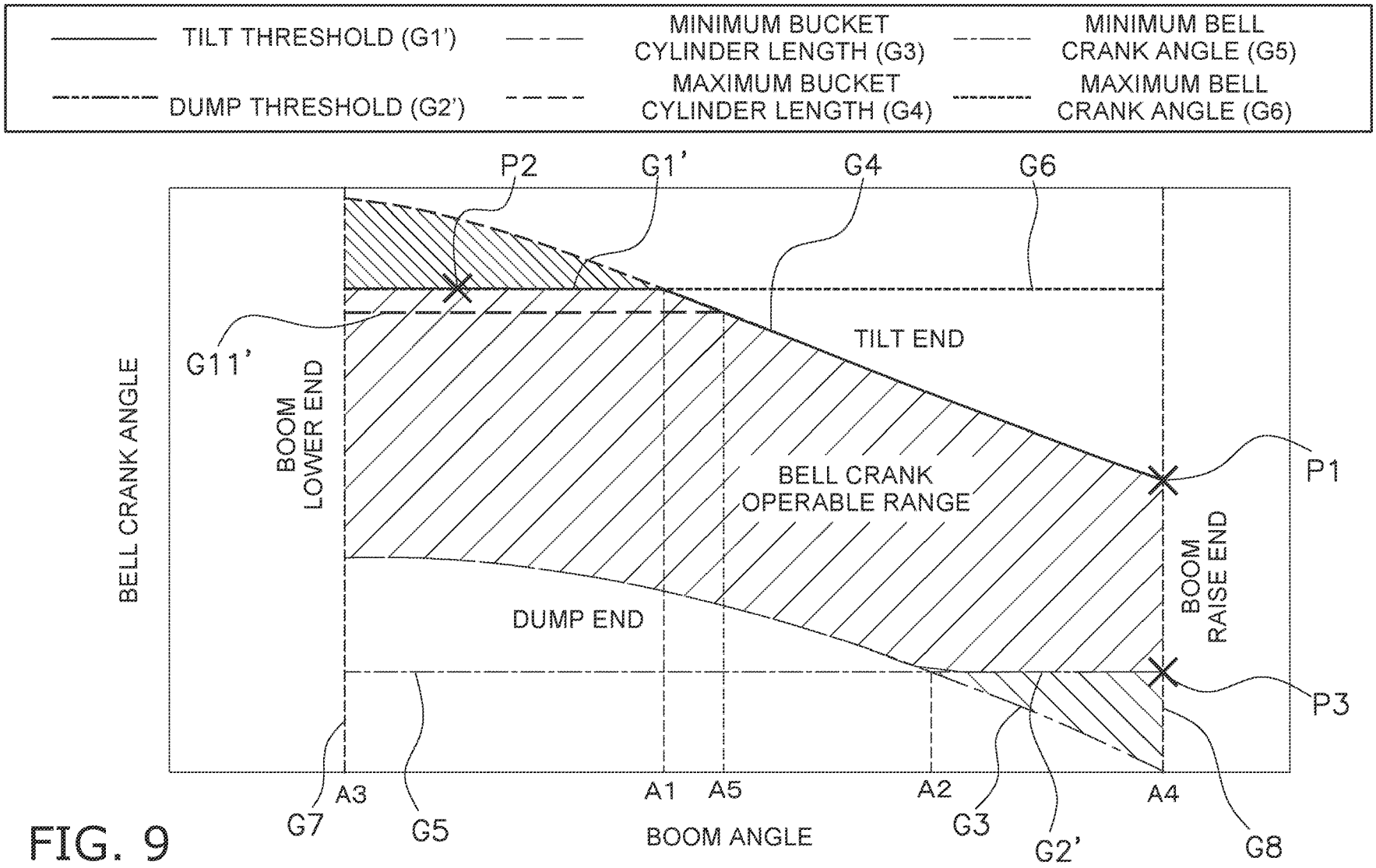
FIG. 9 is a view showing a graph in which the vertical axis of the graph of FIG. 8 is converted into a bell crank angle.

FIG. 9 is a view showing a graph in which the vertical axis of the graph of FIG. 8 is converted into a bell crank angle. As shown in FIG. 9, the graph corresponding to G1 in FIG. 8 is illustrated as G1', and G1' shows the change in the bell crank angle at the tilt end with respect to the boom angle. Further, the graph corresponding to G2 in FIG. 8 is illustrated as G2', and G2' shows the change in the bell crank angle at the dump end with respect to the boom angle. Further, the end line G7 when the boom is lowered is drawn at A3 degree, and the end line G8 when the boom is raised is drawn at A4 degree.

As shown in FIG. 9, in the region where the stroke length of the bucket cylinder 17 does not reach the maximum value at the tilt end, the bucket 15 reaches the tilt end at the maximum value G6 of the bell crank angle. Further, in the region where the stroke length of the bucket cylinder does not reach the minimum value at the dump end, the bucket 15 reaches the dump end at the minimum value G5 of the bell crank angle.

Further, G11 shown by a dotted line in FIG. 4 is a graph showing the bucket cylinder length at the tilt end when the bucket 15 is replaced with another one. The graph corresponding to G11 in FIG. 4 is illustrated as G11' in FIG. 9. In G11 and G11', unlike G1 and G1', the tilt end is reached at the maximum value of the cylinder length of the bucket cylinder 17 when the boom angle is from the maximum value to A5 degrees, and the tilt end is reached before the cylinder length of the bucket cylinder 17 reaches the maximum value when the boom angle is from A5 degrees to the minimum value. The bucket 15 may be replaced with one having a different size by the operator, in which case the mechanical limit also changes and the maximum value of the bell crank angle also changes.

In the bell crank angle calibration, for example, the first bell crank calibration posture may be the minimum value of the bell crank angle, and the second bell crank calibration posture may be the maximum value of the bell crank angle. However, as described above, the maximum value of the bell crank angle changes depending on the presence/absence of the bucket 15 and size of the bucket 15.

Further, the first bell crank calibration posture and the second bell crank calibration posture are preferably postures that are fixed to one posture without depending on the operator. Therefore, the first bell crank calibration posture is defined as the posture at the position P3, and the second bell crank calibration posture is defined as the posture at the position P1.

As shown in FIGS. 7 and 9, the first bell crank calibration posture of work implement 3 at position P3 is a state in which the boom cylinder 16 is extended to the maximum value and the bucket cylinder 17 is contracted to bring the bell crank 18 into contact with the frame part of the boom 14 (see point C2) so that the bucket 15 reaches the damp end.

As shown in FIGS. 5 and 9, the second bell crank calibration posture of work implement 3 at position P1 is a state in which the boom cylinder 16 is extended to the maximum value and the bucket cylinder 17 is extended to the maximum value so that the bucket 15 reaches the tilt end.

In this way, the first bell crank calibration posture can be obtained by extending the boom cylinder 16 to the maximum value and contracting the bucket cylinder 17 until the bell crank 18 contacts the boom 14. Therefore there is no difference in the first bell crank calibration posture depending on the operator and the presence/absence of the bucket 15.

Further, the second bell crank calibration posture can be obtained by extending the boom cylinder 16 to the maximum value and extending the bucket cylinder 17 to the maximum value. Therefore there is no difference in the second bell crank calibration posture depending on the operator and the presence/absence of the bucket 15.

As described above, the posture of the position P1 and the posture of the position P3 are selected as the calibration postures since the postures are fixed to one regardless of the presence or absence and the size of the bucket 15 and regardless of the operator.

Further, the bell crank angle due to the first bell crank calibration posture and the bell crank angle due to the second bell crank calibration posture are stored in advance in the storage section 46.

(Processing Section)

Figure 10:
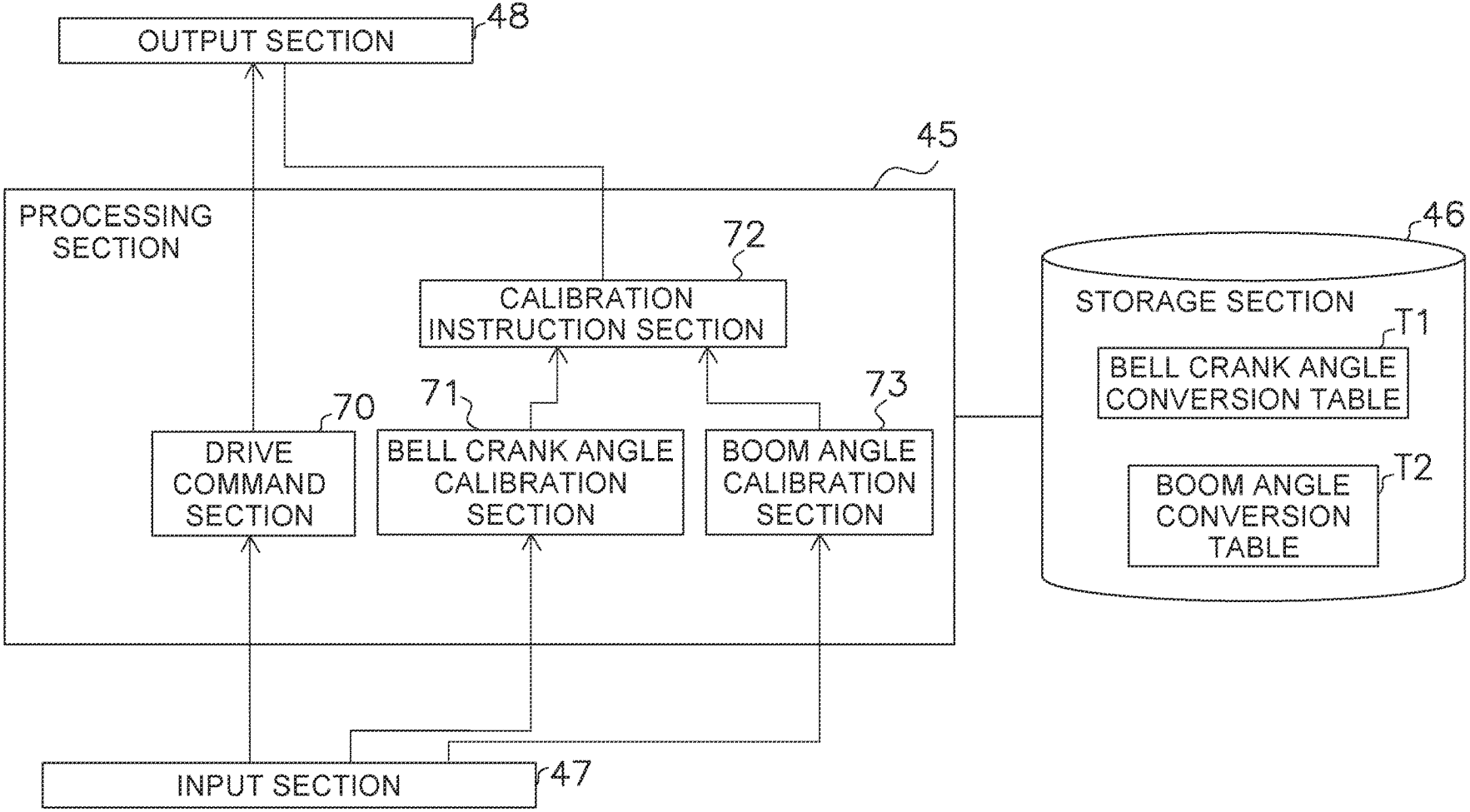
FIG. 10 is a block diagram showing a configuration of a processing section of FIG. 3.

FIG. 10 is a block diagram showing the configuration of the processing section 45 of the present embodiment. The processing section 45 includes a drive command section 70, a bell crank angle calibration section 71 (an example of a calibration section), a boom angle calibration section 73, and a calibration instruction section 72.

(Drive Command Section)

The drive command section 70 creates a drive command based on the operation of the boom operating lever 61 and the bucket operating lever 62 by the operator. When the boom operating lever 61 and the bucket operating lever 62 are operated by the operator, the drive command section 70 acquires signals of the operation amount of the boom operating lever 61 and the bucket operating lever 62 from the first potentiometer 63 and the second potentiometer 64 via the input section 47. Then, the drive command section 70 creates a drive command corresponding to the operation amount signal.

This drive command is a command to drive the boom cylinder 16 or the bucket cylinder 17 so as to correspond to the operation amount signal, and defines the flow rate of the hydraulic fluid supplied to the boom cylinder 16 or the bucket cylinder 17. Specifically, the drive command is a command so that the boom lowering electromagnetic proportional control valve 41, the boom raising electromagnetic proportional control valve 42, the bucket dump electromagnetic proportional control valve 43, or the bucket tilt electromagnetic proportional control valve 44 is set to the opening degree such that the hydraulic fluid of the flow rate corresponding to the operation amount flows.

When a drive command is output to the boom lowering electromagnetic proportional control valve 41, the boom raising electromagnetic proportional control valve 42, the bucket dump electromagnetic proportional control valve 43, or the bucket tilt electromagnetic proportional control valve 44, the boom lowering electromagnetic proportional control valve 41, the boom raising electromagnetic proportional control valve 42, the bucket dump electromagnetic proportional control valve 43, or the bucket tilt electromagnetic proportional control valve 44 is driven according to the opening degree information of the drive command. As a result, the pilot pressure according to the drive command is output from the boom lowering electromagnetic proportional control valve 41, the boom raising electromagnetic proportional control valve 42, the bucket dump electromagnetic proportional control valve 43, or the bucket tilt electromagnetic proportional control valve 44 to the pilot pressure receiving part of the boom operating valve 22 or the bucket operating valve 23. Then the boom cylinder 16 or the bucket cylinder 17 operates in the corresponding directions at a speed corresponding to each pilot oil pressure.

(Bell Crank Angle Calibration Section, Boom Angle Calibration Section, Calibration Instruction Section)

The bell crank angle calibration section 71 calibrates the bell crank angle when the calibration mode execution instruction by the operator using the input/output device 50 is input via the input section 47.

The calibration instruction section 72 causes the display device 52 to display an operation instruction to the operator. Specifically, the calibration instruction section 72 instructs to set the work implement 3 to the first bell crank calibration posture and input the first bell crank detection voltage by the bell crank angle sensor 55. The calibration instruction section 72 instructs to set the work implement 3 to the second bell crank calibration posture, and input the second bell crank detection voltage by the bell crank angle sensor 55.

The bell crank angle calibration section 71 converts the first bell crank detection voltage (an example of the detection value) and the second bell crank detection voltage (an example of the detection value) to a bell crank angle (an example of a measurement angle) based on the bell crank angle conversion table T1 (an example of the conversion value) and rewrites the bell crank angle conversion table T1 stored in the storage section 46 so that the converted bell crank angles match the first bell crank angle (an example of an actual angle) and the second bell crank angle (an example of an actual angle) stored in advance in each calibration posture.

Figure 11B:
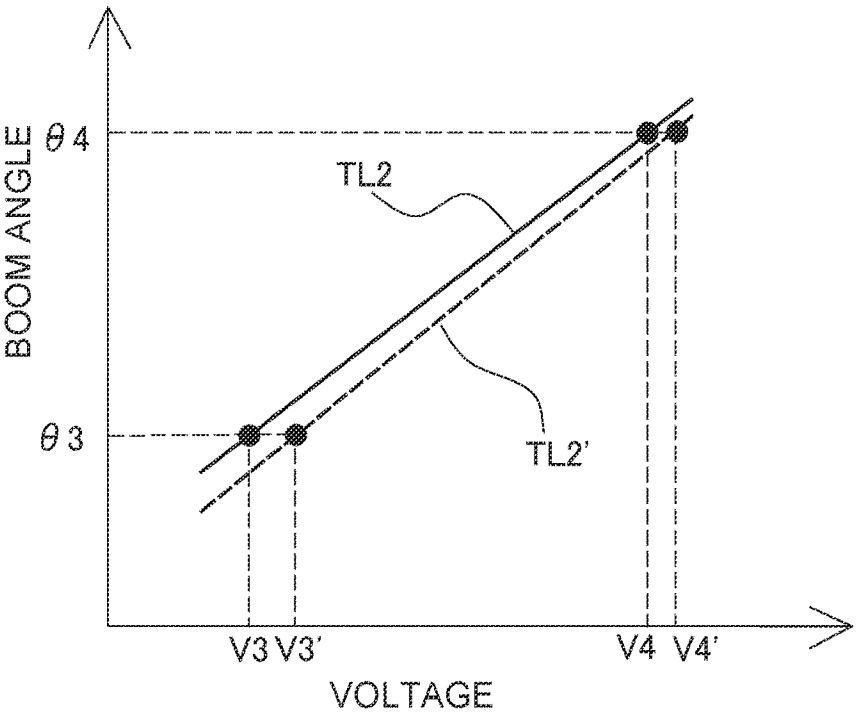
FIG. 11B is a view showing a boom angle conversion table.
Figure 11A:
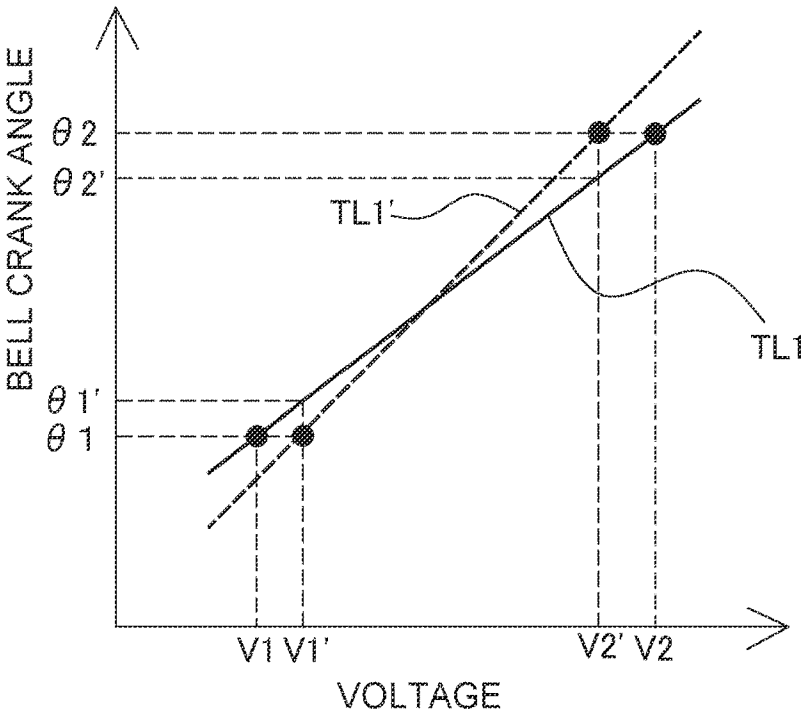
FIG. 11A is a view showing a bell crank angle conversion table.

FIG. 11A is a view showing the bell crank angle conversion table T1. The storage section 46 stores a predetermined initial conversion line TL1 as the initial bell crank angle conversion table T1. In the initial conversion line TL1, the detection voltage at the bell crank angle θ1 in the first bell crank calibration posture is set to V1, and the detection voltage at the bell crank angle θ2 in the second bell crank calibration posture is set to V2.

In the calibration mode, the first bell crank detection voltage V1' from the bell crank angle sensor 55 is input in the state in which the work implement 3 is set to the first bell crank calibration posture by the operator, and the second bell crank detection voltage V2' from the bell crank angle sensor 55 is input in the state in which the work implement 3 is set to the second bell crank calibration posture by the operator.

Then, the bell crank angle calibration section 71 converts the first bell crank detection voltage V1' based on the initial conversion line TL1 to acquire the bell crank angle θF, and converts the second bell crank detection voltage V2' based on the initial conversion line TL1 to acquire the bell crank angle θ2'. The bell crank angle calibration section 71 calibrates the initial conversion line TL1 to create the post-calibration conversion line TL1' so that the bell crank angle 6 1' is the bell crank angle θ1 and the bell crank angle θ2' is the bell crank angle θ2, and stores the post-calibration conversion line TL1' in the storage section 46. That is, the bell crank angle calibration section 71 calibrates the initial conversion line TL1 to create a post-calibration conversion line TL1' so that the bell crank angle at the first bell crank detection voltage V1' is θ1 and the bell crank angle at the second bell crank detection voltage V2' is θ2.

When driving the bucket cylinder 17 after calibration, the detection voltage input from the bell crank angle sensor 55 is converted to the bell crank angle based on the post-calibration conversion line TL1'.

Further, the first bell crank detection voltage V1' in the first bell crank calibration posture is the minimum value of the bell crank angle as illustrated at the position P3 in FIG. 9, but the detection voltage V2' in the second bell crank calibration posture is not the maximum value of the bell crank angle, as illustrated at position P1 in FIG. 9. Therefore, the bell crank angle of the detection voltage V2 or higher is calculated from the extrapolation of a straight line by the post-calibration conversion line TL1' .

The boom angle calibration section 73 calibrates the boom angle when the calibration mode execution instruction by the operator using the input/output device 50 is input via the input section 47.

The calibration instruction section 72 causes the display device 52 to display an operation instruction to the operator. Specifically, the calibration instruction section 72 instructs to input the first boom detection voltage by the boom angle sensor 54 in the state where the work implement 3 is in the first boom calibration posture, and instructs to input the second boom detection voltage by the boom angle sensor 54 in the state where the work implement 3 is in the second boom calibration posture. The first boom calibration posture is a posture in which the boom cylinder 16 is set to the minimum value and the boom 14 is rotated most downward, and the second boom calibration posture is a posture in which the boom cylinder 16 is set to the maximum value and the boom 14 is rotated most upward.

The boom angle calibration section 73 rewrites the boom angle conversion table T2 stored in the storage section 46 based on the first boom detection voltage and the second boom detection voltage.

FIG. 11B is a view showing the boom angle conversion table T2. The storage section 46 stores a predetermined initial conversion line TL2 as the initial boom angle conversion table T2. In the initial conversion line TL2, the boom detection voltage at the boom angle θ3 in the first boom calibration posture is set to V3, and the boom detection voltage at the boom angle θ4 in the second boom calibration posture is set to V4.

In the calibration mode, the first boom detection voltage V3' from the boom angle sensor 54 is input in the state in which the work implement 3 is set to the first boom calibration posture by the operator, and the second boom detection voltage V4' from the boom angle sensor 54 is input in the state in which the work implement 3 is set to the second boom calibration posture by the operator.

Then, the boom angle calibration section 73 calibrates the initial conversion line TL2 to create a post-calibration conversion line TL2' so that the boom angle at the first boom detection voltage V3' is θ3 and the boom angle at the second boom detection voltage V4' is θ4, and stores the post-calibration conversion line TL2' in the storage section 46.

The storage section 46 stores the bucket cylinder length table illustrated in FIG. 12. This bucket cylinder length table is obtained in advance by the design value. The bucket cylinder length is calculated from the bucket cylinder length table based on the value of the bell crank angle θb and the value of the boom angle θa. For example, when the boom angle is θ14 and the bell crank angle is θ3, the bucket cylinder length is L33. In addition, the interval between each numerical value is obtained by interpolation calculation.

In the present embodiment, since the bell crank angle is calibrated together with the boom angle calibration, accurate values can be obtained for any of the boom angle, the bell crank angle, and the bucket cylinder length.

Since the posture of work implement 3 can be detected as an accurate value, for example, mitigation stop control to mitigate speed and to stop when reaching the dump end and the tilt end can be performed with high accuracy.

(Operation)

Next, the operation of the embodiment according to the present invention will be described.

(Method for Calibrating Bell Crank Angle)

The method for calibrating the bell crank angle of the wheel loader of the present embodiment will be described below, and an example of the method for calibrating the wheel loader will be described.

Figure 13:
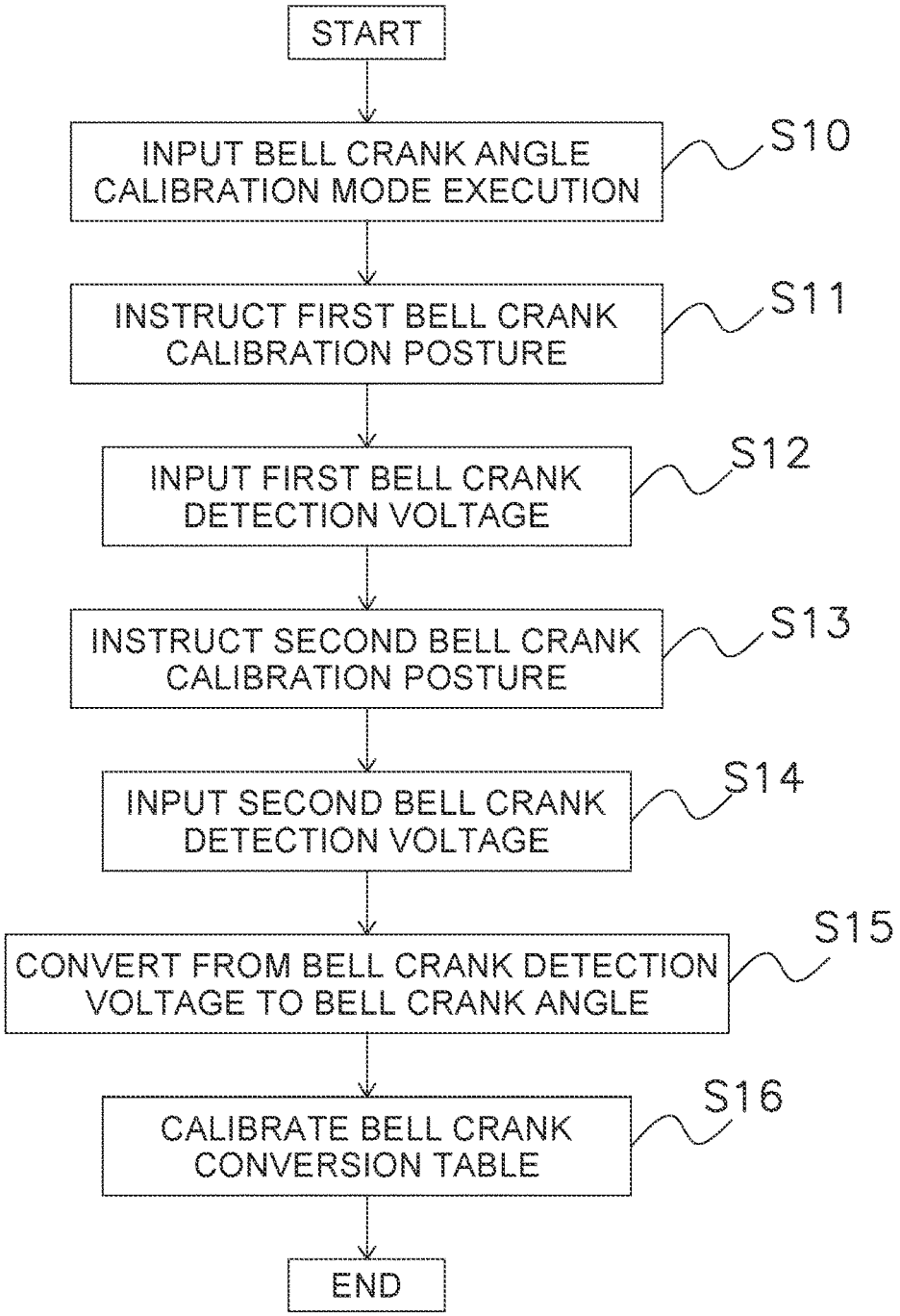
FIG. 13 is a flow chart showing a method for calibrating a bell crank angle of a wheel loader according to the embodiment of the present invention.

FIG. 13 is a flow chart showing the method for calibrating the bell crank angle of the wheel loader 1 of the present embodiment.

First, in step S10, when a calibration mode execution instruction by the operator using the input/output device 50 is input to the bell crank angle calibration section 71 via the input section 47, the control proceeds to step S11.

In step S11, the calibration instruction section 72 causes the display device 52 to display an operation instruction for causing the operator to set the work implement 3 to the first bell crank calibration posture.

The calibration instruction section 72 causes the display device 52 to display an instruction such as "Please rotate the boom 14 to the uppermost position, set the bucket 15 to the full dump state, and then press the input button." As a result, the work implement 3 is set to the first bell crank calibration posture in which the boom cylinder 16 is extended to the maximum value and the bucket cylinder 17 is contracted to bring the bell crank 18 into contact with the frame part of the boom 14 (see point C2) so that the bucket 15 reaches the damp end.

Next, in step S12 (an example of the first input step), when the operator sets the work implement 3 to the first bell crank calibration posture and then inputs using the input device 51, the first bell crank detection voltage V1' by the bell crank angle sensor 55 is input to the input section 47.

Next, in step S13, the calibration instruction section 72 causes the display device 52 to display an operation instruction for causing the operator to set the work implement 3 to the second bell crank calibration posture.

The calibration instruction section 72 causes the display device 52 to display an instruction such as "Please rotate the boom 14 to the uppermost position, set the bucket 15 in the full tilt state, and then press the input button." As a result, the work implement 3 can be set to the second bell crank calibration posture in which the boom cylinder 16 is extended to the maximum value and the bucket cylinder 17 is extended to the maximum value so that the bucket 15 reaches the tilt end.

Next, in step S14 (an example of the second input step), when the operator sets the work implement 3 to the second bell crank calibration posture and then inputs using the input device 51, the bell crank detection voltage V2' by the bell crank angle sensor 55 is input to the input section 47.

Next, in step S15 (an example of the conversion step), the bell crank angle calibration section 71 converts the first bell crank detection voltage V1' based on the initial conversion line TL1 to acquire the bell crank angle θ1', and converts the second bell crank detection voltage V2' based on the initial conversion line TL1 to acquire the bell crank angle θ2'.

Next, in step S16 (an example of a calibration step), the bell crank angle calibration section 71, as illustrated in FIG. 11A, calibrates the initial conversion line TL1 to create the post-calibration conversion line TL1' so that the bell crank angle θ1' is the bell crank angle θ1 and the bell crank angle θ2' is the bell crank angle is θ2 and stores the post-calibration conversion line TL1' in the storage section 46.

(Method for Calibrating Boom Angle)

Figure 14:
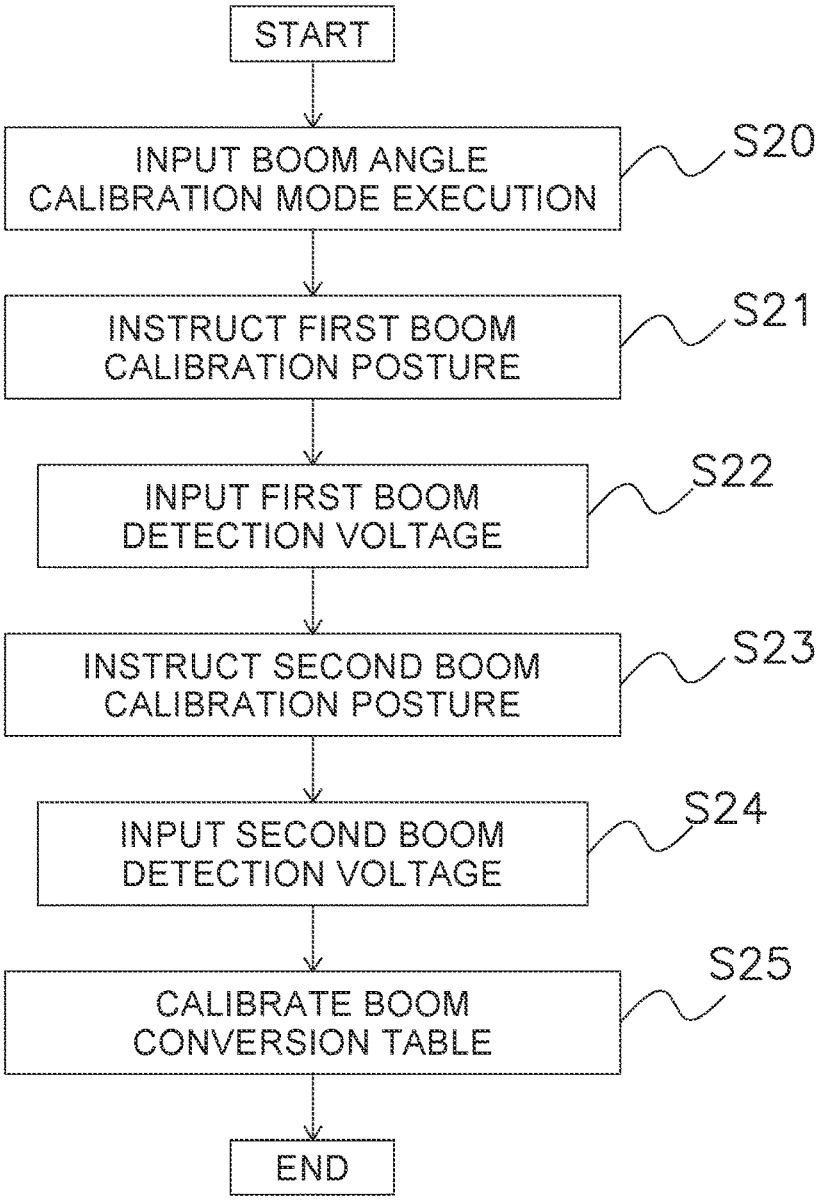
FIG. 14 is a flow chart showing a method for calibrating a boom angle of a wheel loader according to the embodiment of the present invention.

FIG. 14 is a flow chart showing a method for calibrating the boom angle of the wheel loader 1 of the present embodiment.

First, in step S20, when the calibration mode execution instruction by the operator using the input/output device 50 is input to the boom angle calibration section 73 via the input section 47, the control proceeds to step S21.

In step S21, the calibration instruction section 72 causes the display device 52 to display an operation instruction for causing the operator to set the work implement 3 to the first boom calibration posture.

The calibration instruction section 72 causes the display device 52 to display an instruction such as "Please press the input button after rotating the boom 14 to the lowest position". As a result, the work implement 3 can be set to the first boom calibration posture in which the boom cylinder 16 is contracted to the minimum value so that the boom 14 is in the lowest position.

Next, in step S22, when the operator sets the work implement 3 to the first boom calibration posture and then inputs using the input device 51, the first boom detection voltage V3' by the boom angle sensor 54 is input to the input section 47.

Next, in step S23, the calibration instruction section 72 causes the display device 52 to display an operation instruction for causing the operator to set the work implement 3 to the second boom calibration posture.

The calibration instruction section 72 causes the display device 52 to display an instruction such as "Please press the input button after rotating the boom 14 to the uppermost position". As a result, the work implement 3 can be set to the second boom calibration posture in which the boom cylinder 16 is extended to the maximum value so that the boom 14 is in the highest position.

Next, in step S24, when the operator sets the work implement 3 to the second boom calibration posture and then inputs using the input device 51, the second boom detection voltage V4' by the boom angle sensor 54 is input to the input section 47.

Next, in step S25, as illustrated in FIG. 11B, the boom angle calibration section 73 calibrates the initial conversion line TL2 of the boom angle conversion table T2 to create the post- calibration conversion line TL2' so that the boom angle at the first boom detection voltage V3' is θ3 and the boom angle at the second boom detection voltage V4' is θ4, and stores the postcalibration conversion line TL2' in the storage section 46.

(Features)

(1)

The method for calibrating the wheel loader 1 (an example of a work machine) of the present embodiment is a method for calibrating the wheel loader 1 including the vehicle body 2 (an example of a main body), the boom 14 configured to drive with respect to the vehicle body 2, the bucket 15 (an example of a work tool) connecting the boom 14 and configured to drive with respect to the boom 14, the bucket cylinder 17 (an example of an actuator) connecting to the vehicle body 2 and the bucket 15 respectively and configured to drive the bucket 15, and the bell crank 18 (an example of a sub-link) configured to transmit the drive of the bucket cylinder 17 to the bucket 15, and includes steps S12 and S14 (an example of an output step), step S15 (an example of a conversion step), and step S16 (an example of a calibration step). In steps S12 and S14, detection voltages V1' and V2' (examples of detection values) for detecting the angle of the bell crank 18 with respect to the boom 14 in the predetermined posture of the boom 14 and the bucket posture, which are specified, are output. In step S15, the detection voltages V1' and V2' are converted as the bell crank angles θ1'and θ2' (an example of the measurement angle) of the bell crank 18 with respect to the boom 14 based on the bell crank angle conversion table T1 (an example of the conversion value). In step S16, the bell crank angle conversion table T1 is calibrated based on the relationship between the bell crank angles θ1' and θ2' and the bell crank angles θ1 and θ2 (an example of the actual angle) in the specified bucket postures.

In this way, with operating the wheel loader 1 actually, it is possible to acquire the actual angle of the bell crank 18 with respect to the boom 14 in each of the two postures in the operating region.

Therefore, it is possible to calibrate the bell crank angle conversion table that converts the detection voltage for detecting the angle of the bell crank 18 with respect to the boom 14 into the measurement angle.

(2)

In the method for calibrating the wheel loader 1 (an example of a work machine) of the present embodiment, in step S16, the bell crank angle conversion table T1 (an example of conversion value) is calibrated so that the bell crank angles θ1' and θ2' (an example of the measurement angle) match the bell crank angles θ1 and θ2 (an example of the actual angle).

As a result, the measurement value by the bell crank angle sensor 55 can be calibrated so as to correspond to the actual angle.

(3)

In the method for calibrating the wheel loader 1 (an example of a work machine) of the present embodiment, the conversion value is the bell crank angle conversion table T1 for converting the detection voltage (an example of the detection value) into the bell crank angle (measurement angle).

The measurement angle can be calibrated by rewriting the conversion table for converting the detection voltage to the measurement angle. The conversion value is not limited to the conversion table, and may be, for example, a conversion curve.

(4)

In the method for calibrating the wheel loader 1 (an example of a work machine) of the present embodiment, there are a plurality of bucket postures, and in steps S12 and S14, the detection voltages V1' and V2' for detecting the angle of the bell crank 18 with respect to the boom 14 in each of the plurality of bucket postures are output.

As a result, the bell crank angle conversion table T1 can be calibrated using the detection voltages at a plurality of points.

(5)

In the method for calibrating the wheel loader 1 (an example of a work machine) of the present embodiment, the plurality of bucket postures include the dump posture and the tilt posture. In steps S12 and S14, detection voltages V1' and V2' for detecting the angle of the bell crank 18 with respect to the boom 14 in each of the dump posture and the tilt posture are output.

Thereby, the bell crank angle conversion table T1 can be calibrated using the detection voltages in the dump posture and the tilt posture. In addition, the calibration standard is clarified, and error factors such as operation dependence can be eliminated from the operator, so that the calibration work can be performed reliably.

(6)

In the method for calibrating the wheel loader 1 (an example of a work machine) of the present embodiment, the dump posture and the tilt posture are the postures at the mechanism limit by the bell crank 18 or by the operation limit of the bucket cylinder 17.

In this way, by using the mechanism limit or the cylinder movable limit, the calibration standard is clarified, and error factors such as operation dependence can be eliminated from the operator, so that the calibration work can be performed reliably.

(7)

In the method for calibrating the wheel loader 1 (an example of a work machine) of the present embodiment, the predetermined posture of the boom 14 is the posture in which the boom 14 is raised.

As a result, the calibration work can be performed using the bucket posture when the boom 14 is raised.

(8)

The controller 80 of the wheel loader 1 (an example of a work machine) of the present embodiment is a controller of the wheel loader 1 including the vehicle body 2 (an example of a main body), the boom 14 configured to drive with respect to the vehicle body 2, the bucket 15 (an example of a work tool) connecting the boom 14 and configured to drive with respect to the boom 14, the bucket cylinder 17 (an example of an actuator) connecting to the vehicle body 2 and the bucket 15 respectively and configured to drive the bucket 15, and the bell crank 18 (an example of a sub-link) configured to transmit the drive of the bucket cylinder 17 to the bucket 15, and includes the input section 47 (an example of an acquisition section), the display device 52 (an example of a display section), and the bell crank angle calibration section 71 (an example of a calibration section). The input section 47 acquires a detection voltage (an example of a detection value) for detecting the angle of the bell crank 18 with respect to the boom 14. The display device 52 displays information for specifying the predetermined posture of the boom 14 and the bucket posture when calibrating the bell crank angle conversion table T1 (an example of a conversion value) for converting the detection voltage as the measurement angle of the bell crank 18 with respect to the boom 14. The bell crank angle calibration section 71 calibrates the bell crank angle conversion table T1 by the relationship between the bell crank angles θ1 and θ2 (an example of the actual angle) in the specified bucket posture and the bell crank angles θ1' and θ2' (an example of the measurement angle) obtained by converting the detection voltages V1' and V2' in the specified predetermined posture of the boom 14 and the specified bucket posture, which are input based on the display of the display device 52, based on the bell crank angle conversion table T1.

In this way, with operating the wheel loader 1 actually, it is possible to acquire the actual angle of the bell crank 18 with respect to the boom 14 in each of the two postures in the operating region.

Therefore, it is possible to calibrate the bell crank angle conversion table for converting the detection voltage for detecting the angle of the bell crank 18 with respect to the boom 14 into the measurement angle.

(9)

The wheel loader 1 (an example of a work machine) of the present embodiment is an articulated wheel loader in which the front frame 11 and the rear frame 12 are connected, and includes the controller 80 and the bell crank angle sensor 55. The bell crank angle sensor 55 transmits the detection voltage (an example of a detection value) for detecting the angle of the bell crank 18 with respect to the boom 14 to the controller 80 of the wheel loader 1.

It is possible to provide a wheel loader 1 capable of calibrating the angle for detecting the angle of the bell crank 18 with respect to the boom 14.

Other Embodiments

Although one embodiment of the present invention has been described above, the present invention is not limited to the above embodiment, and various modifications can be made without departing from the gist of the invention.

(A)

In work implement 3 of the above embodiment, the attachment part 18*a* of the bell crank 18 to the bucket cylinder 17 is arranged on the cab 5 side in the rotation direction with respect to the attachment part 18*g* of the bucket 15 to the rod 18*f*, but this is not the only option. The attachment part of the rod 18*f* of the bell crank 18 to the bucket 15 may be arranged on the cab 5 side with respect to the attachment part to the bucket cylinder 17.

(B)

In work implement 3 of the above embodiment, the bucket 15 rotates to the tilt side when the bucket cylinder 17 extends, and the bucket 15 rotates to the dump side when the bucket cylinder 17 contracts, but this is not the only option. The bucket 15 may rotates to the dump side when the bucket cylinder 17 extends, and the bucket 15 may rotate to the tilt side when the bucket cylinder 17 contracts.

(C)

In the above embodiment, the bell crank angle sensor 55 outputs the detection voltage to the control device 27, but it does not have to be limited to the voltage value.

Further, in the above embodiment, for example, a potentiometer is used as the bell crank angle sensor 55, but this is not the only option. An IMU (Inertial measurement unit) or the like may be used.

(D)

In the above embodiment, the bell crank angle is calibrated in the state in which the bucket 15 is attached to the boom 14, but the bucket 15 may not be attached.

(E)

In the above embodiment, the angle of the bell crank shown in FIG. 2 is used as an example of the posture of the bell crank 18 with respect to the boom 14, but if the posture of the bell crank 18 with respect to the boom 14 is uniquely determined, it is not limited to θb in FIG. 2, and a combination of a plurality of angles may be used.

The method for calibrating a wheel loader of the present invention has an effect that the measurement value of the bell crank angle can be calibrated in the actual operating angle region, and is useful for a controller of a wheel loader, a wheel loader, and the like.

The invention claimed is:

1. A method for calibrating a work machine including a main body, a boom configured to drive with respect to the main body, a work tool connecting to the boom, the work tool being configured to drive with respect to the boom, an actuator connecting to the main body and the work tool respectively, the actuator being configured to drive the work tool, and a sub-link configured to transmit drive of the actuator to the work tool, the method comprising:

outputting a detection value to detect an angle of the sub-link with respect to the boom in a predetermined posture of the boom and a work tool posture, which are specified;

converting the detection value as a measurement angle of the sub-link with respect to the boom based on a conversion value; and calibrating the conversion value based on a relationship between the measurement angle and an actual angle in the work tool posture which is specified.

2. The method for calibrating the work machine according to claim 1, wherein the conversion value is calibrated so that the measurement angle matches the actual angle.

3. The method for calibrating the work machine according to claim 1, wherein the conversion value is obtained from a conversion table to convert the detection value into the measurement angle.

4. The method for calibrating the work machine according to claim 1, wherein there are a plurality of work tool postures, and a detection value to detect the angle of the sub-link with respect to the boom in each of the plurality of work tool postures is output.

5. The method for calibrating the work machine according to claim 4, wherein the plurality of work tool postures include a dump posture and a tilt posture, and a detection value to detect the angle of the sub-link with respect to the boom in each of the dump posture and the tilt posture is output.

6. The method for calibrating the work machine according to claim 5, wherein the dump posture and the tilt posture are postures at a mechanism limit due to the sub-link or an operation limit of the actuator.

7. The method for calibrating the work machine according to claim 1, wherein the predetermined posture of the boom is a posture in which the boom is raised.

8. A controller for a work machine including a main body, a boom configured to drive with respect to the main body, a working tool connecting to the boom, the work tool being configured to drive with respect to the boom, an actuator connecting to the main body and the working tool respectively, the actuator being configured to drive the work tool, and a sub-link configured to transmit drive of the actuator to the work tool, the controller comprising:

an acquisition section configured to acquire a detection value to detect an angle of the sub-link with respect to the boom;

a display section configured to display information to specify a predetermined posture of the boom and a work tool posture when calibrating a conversion value to convert the detection value as a measurement angle of the sub-link with respect to the boom; and a calibration section configured to calibrate the conversion value by a relationship of an actual angle in a specified work tool posture and the measurement angle obtained by converting the detection value in a specified predetermined posture of the boom and the specified work tool posture, which are input based on a display on the display section, based on the conversion value.

9. A work machine including the controller of claim 8, the work machine being an articulated wheel loader in which a front frame and a rear flame are connected, the work machine further comprising:

an angle detection section configured to transmit a detection value to detect an angle of the sub-link with respect to a boom to the controller of the wheel loader.

* * * * *